US010465502B2

(12) United States Patent
El-Khazindar et al.

(10) Patent No.: US 10,465,502 B2
(45) Date of Patent: Nov. 5, 2019

(54) RESERVOIR EFFLUENT AUTO SAMPLER AND DETECTION SYSTEM FOR TRACERS

(71) Applicant: Schlumberger Technology Corporation, Sugar land, TX (US)

(72) Inventors: Yasser Mahmoud El-Khazindar, Giza (EG); Richard Todd Meaux, Richmond, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 386 days.

(21) Appl. No.: 14/788,531

(22) Filed: Jun. 30, 2015

(65) Prior Publication Data

US 2015/0377021 A1 Dec. 31, 2015

Related U.S. Application Data

(60) Provisional application No. 62/018,808, filed on Jun. 30, 2014.

(51) Int. Cl.

| | |
|---|---|
| ***E21B 47/11*** | (2012.01) |
| ***E21B 49/08*** | (2006.01) |
| ***E21B 47/10*** | (2012.01) |

(52) U.S. Cl.

CPC ..... *E21B 47/1015* (2013.01)

(58) Field of Classification Search

CPC ..... E21B 47/1015; E21B 49/08; E21B 49/086
USPC ..... 166/250.12, 264
See application file for complete search history.

(56) References Cited

U.S. PATENT DOCUMENTS

| | | | | |
|---|---|---|---|---|
| 4,454,773 | A * | 6/1984 | Brunner | E21B 49/086 141/236 |
| 4,788,848 | A * | 12/1988 | Hsueh | E21B 43/24 166/250.12 |
| 6,714,872 | B2 * | 3/2004 | DiFoggio | G01N 33/2823 702/12 |
| 7,158,887 | B2 * | 1/2007 | Betancourt | E21B 49/08 702/11 |
| 8,596,354 | B2 * | 12/2013 | Hartshorne | E21B 47/1015 166/250.12 |
| 9,267,371 | B2 * | 2/2016 | Blair | E21B 47/1015 |
| 9,638,024 | B2 * | 5/2017 | Kilaas | E21B 47/1015 |
| 2006/0144588 | A1 * | 7/2006 | Ferguson | E21B 47/1015 166/252.6 |
| 2011/0257887 | A1 * | 10/2011 | Cooper | E21B 47/1015 702/12 |
| 2013/0277543 | A1 * | 10/2013 | Ramirez Sabag | E21B 47/1015 250/259 |
| 2014/0343908 | A1 * | 11/2014 | Nyhavn | E21B 47/1015 703/2 |
| 2015/0034309 | A1 * | 2/2015 | Blair | E21B 47/1015 166/250.12 |
| 2017/0138191 | A1 * | 5/2017 | Patil | E21B 49/088 |

FOREIGN PATENT DOCUMENTS

| | | | | |
|---|---|---|---|---|
| WO | WO-2013062417 | A1 * | 5/2013 | E21B 47/1015 |

* cited by examiner

*Primary Examiner* — Kenneth L Thompson
(74) *Attorney, Agent, or Firm* — Cameron R. Sneddon

(57) ABSTRACT

Methods and devices for sampling tracers may include providing tracers into a wellbore, taking samples of the fluids exiting the wellbore, and quantifying an amount of tracer returning from the well, wherein the samples are automatically taken based on a predetermined profile.

6 Claims, 3 Drawing Sheets

RESERVOIR EFFLUENT AUTO SAMPLER AND DETECTION SYSTEM FOR TRACERS

CROSS-REFERENCE TO RELATED APPLICATIONS

This application claims priority to U.S. Provisional Application Ser. No. 62/018,808, filed Jun. 30, 2014, which is herein incorporated by reference.

BACKGROUND

Field

The present disclosure relates to techniques for automatically taking samples. More particularly, the present disclosure relates to automatically sampling tracers over a period of time after the tracers are injected into the wellbore.

Description of the Related Art

Tracer technology has been in use for decades within the oilfield industry. There are a number of applications where this technology is used; primarily in the petro-chemical industry for catalyst operational and efficiency understanding, in Enhanced Oil Recovery (EOR) for reservoir understanding to identify flow regimes, residual oil saturation (Sor) fluid behavior movements, sweep efficiency, in downhole completion design and reservoir characterization for water breakthrough detection, clean-up verification, monitor water floods, completion integrity, downhole production profiling, in shale and tight gas reservoir characterization for fracture network profiling, clean-up efficiency, flow mapping, zonal contribution, and clean-up geometry to name a few applications.

SUMMARY

Certain aspects of some embodiments disclosed herein are set forth below. It should be understood that these aspects are presented merely to provide the reader with a brief summary of certain forms the embodiments might take and that these aspects are not intended to limit the scope of the disclosure. Indeed, the disclosure may encompass a variety of aspects that may not be set forth below.

In some embodiments, a method of sampling tracers includes providing tracers into a wellbore, taking samples of the fluids exiting the wellbore; and, quantifying an amount of tracer returning from the well, wherein the samples are automatically taken based on a predetermined profile.

In some embodiments, a method of sampling tracers includes providing tracers into a well, taking samples of a fluid exiting a well at a first profile, and measuring a parameter of the fluid or well. The first profile is changed to a second profile based on the measured parameter and samples of the fluid exiting the wellbore at the second profile are taken.

In some embodiments, an apparatus for sampling tracers provided into a wellbore includes at least one valve fluidly connected to the fluid exiting the wellbore, at least one sample container fluidly connected to the valve, and a controller operatively connected to the valve, wherein the controller is programmed to operate the valve based on a predetermined profile.

BRIEF DESCRIPTION OF THE DRAWINGS

So that the manner in which the above recited features can be understood in detail, a more particular understanding may be had when the following detailed description is read with reference to certain embodiments, some of which are illustrated in the appended drawings in which like characters represent like parts throughout the drawings. It is to be noted, however, that the appended drawings illustrate only some embodiments and are therefore not to be considered limiting of its scope, and may admit to other equally effective embodiments.

DETAILED DESCRIPTION

Figure 1A:
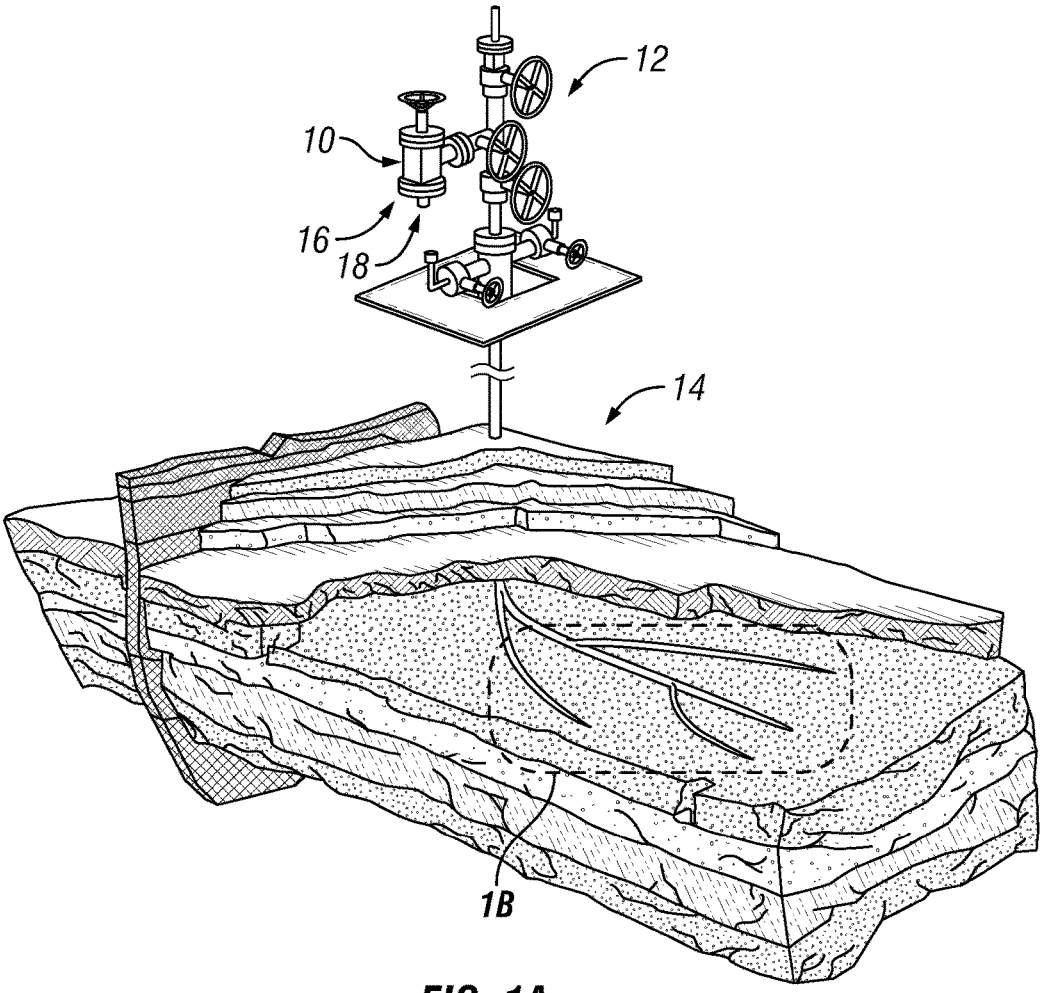
FIG. 1A shows an auto-sampling device according to some embodiments of the disclosure for a typical job where the tracers are permanently installed in a completion tool component and/or injected during a tracer injection stage with the fracturing fluid or media for EOR applications.

In the following description, numerous details are set forth to provide an understanding of the present disclosure. It will be understood by those skilled in the art, however, that the embodiments of the present disclosure may be practiced without these details and that numerous variations or modifications from the described embodiments may be possible.

In the specification and appended claims: the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

The disclosure relates to the design and development of a method and device that provides auto-sampling a representative sample and/or auto-analyzing either permanent or injected tracer components which could include many types of chemicals, fluorescents, salts, radioactive isotopes, DNA strains, nano-tubes, and the like as a means to make the sampling, analysis, and interpretation of tracer application more efficient, cost effective, and reliable for characterizing the reservoir.

Tracer technology may be deployed using one of many approaches. For example, it may be deployed by injecting tracers into the reservoir during an EOR pilot or post-pilot study/testing to determine single-well oil saturation (Sor), inter-well connectivity and water/polymer sweep efficiency which will provide better understanding of the best EOR approach and determine project economics. It may also be deployed by permanently installing solid or gel tracers into certain components of the completion tool design that will dissolve in the presence of oil, water, or gas to detect water or oil breakthrough for reservoir characterization and/or zonal contribution for diagnostic opportunities and subsequent adjustment decisions on production of the monitored (traced) zones of interest. It may also be deployed by injecting tracers into the reservoir during reservoir fracturing operations for proppant placement, verify clean-up efficiency, flow mapping, zonal contribution, future completion design, determine clean-up geometry, and general reservoir characterization that will dissolve in the presence of oil, water, or gas that will allow the operator a better understand the facture network, design, and reservoir contribution and efficiency of the operations.

The challenge in the above applications is determining the ideal time and frequency to sample and analyze the returned tracer during the well effluent flowback periods (oil, gas, and water), which can be done over the course of a short time frame (hours/days) to a longer timeframe (weeks/months/years). Another challenge is related to the amount of volume that is sampled during the sampling operation, meaning that there is typically only one option—the constant size of the sampling container.

The current method includes taking many indiscreet physical pressurized or atmospheric surface samples (usually in sample containers or jars) over a predetermined sequence for an estimated amount of time. The many samples are then indiscreetly analyzed for tracer amount, such as concentration, and interpreted for the most likely outcome for tracer concentration by zone or stage of the EOR or fracturing or completion operation to determine reservoir characterization of the said application. Similarly, the sample volume is a constant and is not adjusted to the importance of the sample, to the time the sample is taken and/or any other criteria for that matter.

This process is inefficient, costly and complex, and in many cases the analysis and interpretation results can be inconclusive. Additionally, the operator can miss the optimal sampling windows for collecting the best quality sample for analytical and interpretation results.

Figure 1B:
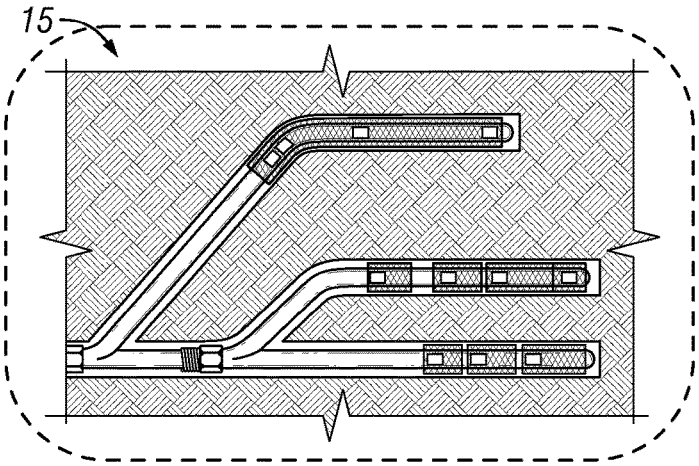
FIG. 1B shows a close-up view of a portion of FIG. 1A.

Methods and devices are disclosed to improve the current process. FIGS. 1A and 1B show an auto-sampling device 10 according to some embodiments of the disclosure for a typical job where the tracers are permanently installed in a completion tool component 15 in a wellbore 14 and/or injected during a tracer injection stage with the fracturing fluid or media for EOR applications in the wellbore 14. The produced wellbore effluents are auto-sampled at the surface during a predetermined set sampling sequence via the auto-sampling device 10. The auto-sampling device 10 may have a sampling port and valve 12 that will allow for the well effluent to flow into the device to the sampling container 16. The auto-sampler 10 may include a controller 18 operatively connected to the valve 12 where the controller 18 is programmed to operate the valve based on predetermined profile.

Figure 2A:
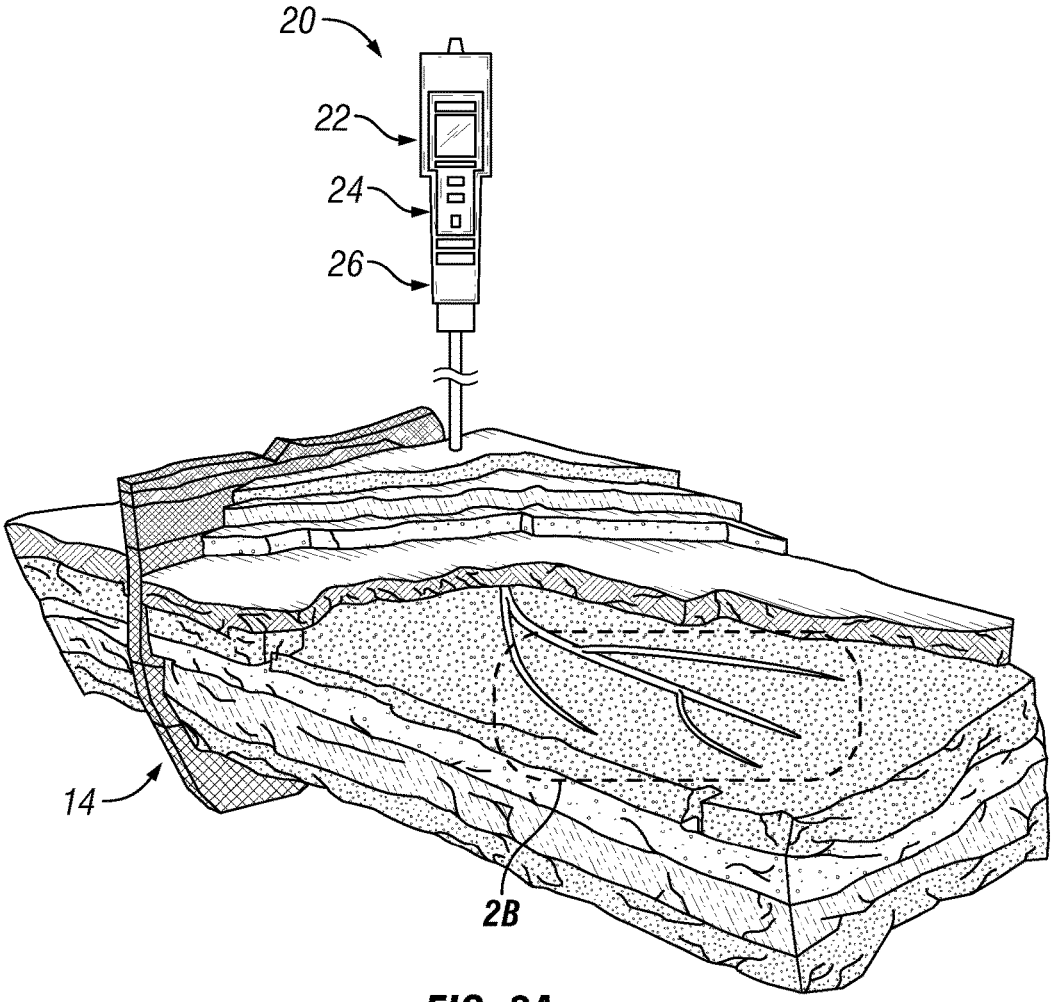
FIG. 2A shows an auto-analyzer device according to some embodiments of the disclosure for a typical job where the tracer is permanently installed in a completion tool component and/or temporarily during a tracer injection stage with the fracturing fluid or media for EOR applications.
Figure 2B:
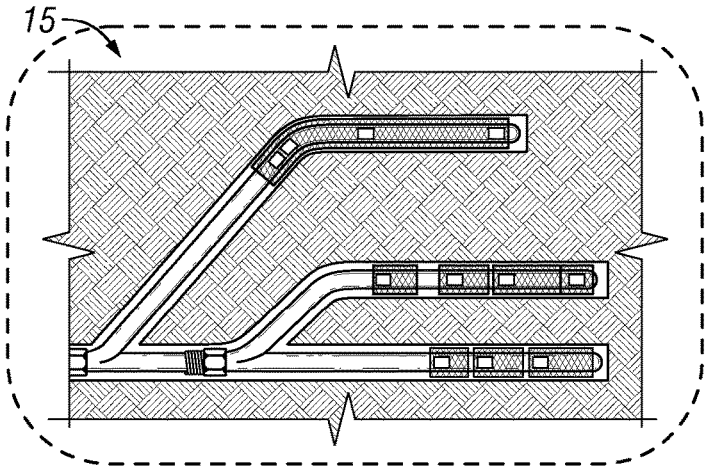
FIG. 2B shows a close-up view of a portion of FIG. 2A.

FIGS. 2A and 2B show an auto-analyzer device 20 according to some embodiments of the disclosure for a typical job where the tracer is permanently installed in a completion tool component 15 and/or temporarily during a tracer injection stage with the fracturing fluid or media for EOR applications. The produced wellbore 14 effluents are auto-analyzed (as a detection device) at the surface during a predetermined set analysis sequence via the auto-analysis device. The auto-analyzer device 20 may include a transmitter 22 to transmit data and information to another location or to provide a communication pathway between the auto-analyzer device 20 and another computer. The auto-analyzer device 20 may also include an electrode array 26 and a concentration computer 24 for determining the concentration level of the tracer return.

A shown in FIGS. 1 and 2, the current disclosure provides an application for surface real-time, in-line auto sampling device 10 and/or auto analysis device 20 that will allow the operator to either auto sample and/or auto analyze the tracer in the spiked well effluents (tracers injected or permanently installed with the completion components, such as deployed completion hardware or fracture stages 15) at a pre-determined time sequence or profile while the well is flowing. Similarly, the sample volume can be adjusted relative to the profile.

The determined time sequence can be modified during the sampling operations to achieve optimal sampling results. The auto-sampler 10 and/or analyzer 20 are installed at surface on the wellhead or downstream the wellhead on a flowline/choke manifold/separator. The device 10, 20 may have a sampling port and valve 12 that will allow for the well effluent to flow into the device to the sampling container 16. The device 10, 20 may have a probe that will allow for the detection of the tracer during well flow to the surface device, or may have some other means of quantifying the amounts of tracer returning from the well. This would eliminate the subjectivity from the tracer sampling and analysis operations. The device (i.e. auto-sampler 10 and/or auto-analyzer 20) may have a controller 18 operatively connected to the valve 12 where the controller 18 is programmed to operate the valve based on predetermined profile.

Additionally, such auto sampling and/or auto analysis device/system may have the ability to be permanently or temporarily connected to a wellhead, choke manifold, or piping system as a programmable device that allows for pre-determined sampling rates of well effluent (and/or having the ability to change the sampling rates in real-time) as they flow to surface for collection into an assortment of containers for subsequent fluid analysis. The device could incorporate a port and/or probe to acquire the sample. The system may also have the ability to be permanently or temporarily connected to a wellhead, choke manifold, or piping system as a programmable device that allows for pre-determined well effluent analysis as they flow to surface for eventual detection of the downhole tracer. The device could incorporate a port and/or probe for detection and analysis. The system may also have the ability to notify the operator of when the pre-programmed auto-sampling operation has been completed as well as the ability to notify of when the tracer concentration has increased detection levels or decreased to undetectable levels in the auto-analysis system/device. The communication protocol could be via a direct link to a computer, a building screen, wireless or SCADA system.

Figure 3:
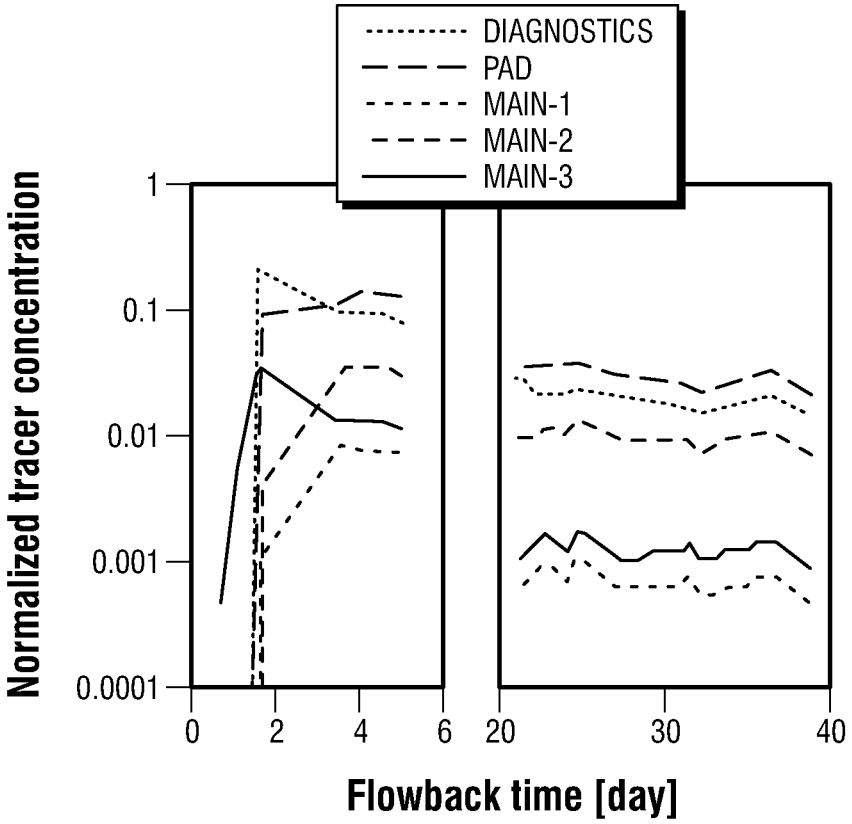
FIG. 3 shows a graph profile of tracer concentration over time.

Utilizing the above and the addition or incorporation of the probe or other tracer level detector within the sampling system, an intelligent sampling system may be created. Such intelligent sampling system would be able to detect levels of tracer concentration (or other means of quantifying the amounts of tracer returning from the well) and, based on such detected levels, would be able to adjust the sampling volume, sampling frequency and/or sampling time period. FIG. 3 shows a graph profile of normalized tracer concentration vs flowback time in days of a diagnostic sample/tracer analysis compared to various other well locations where sampling/analysis has occurred, which profile may be monitored to automatically adjust sampling/analyzing times and/or frequencies, and/or volumes. For example, if the auto-sampler is programmed to take a sample every 3 hours and the concentration levels of the tracer do not significantly change or the change in concentration levels is under a predetermined threshold, then the sampling time may be increased, the sampling frequency may be decreased and/or the sample volume may be adjusted. Alternatively, if the concentration levels of the tracer do change significantly or the change in concentration levels is above a predetermined threshold, then the sampling time may be decreased, the sampling frequency may be increased and/or again, the sample volume may be adjusted.

The system may also have the ability to purge, dump and/or reintroduce the samples into the well effluent. As such, the system may be programmed to only keep or reject samples based on some predetermined criteria. For example, if adjacent samples indicate the same concentration level of the tracer or indicate a change in concentration levels that are below a predetermined threshold, then one of the samples may be rejected as noted above. This would aid in the reduction in the number of samples that are retained.

In addition to the concentration measurement and other means of quantifying the amounts of tracer returning from the well, there may be other parameters that could cause the sampling profile or sampling operation to change and/or be adjusted. For example, the sampling system may be communicably and/or operatively connected, to pressure measurements, flow measurements, temperature measurements, etc. related to the well and/or the fluid being sampled. This connectivity could be automatic or through user intervention. As such, the parameters of the sampling operation, including the sampling time/profile, the sampling frequency and/or the sample volume, may be adjusted based on the measurements. For example, the profile may be set to take a 100 ml sample of fluid every 3 hours. However, unexpectedly the fluid flow rate increases above a pre-determined threshold, which then triggers a change in profile to take a 10 ml sample of fluid every 15 minutes.

Although the preceding description has been described herein with reference to particular means, materials and embodiments, it is not intended to be limited to the particulars disclosed herein; rather, it extends to all functionally equivalent structures, methods, and uses, such as are within the scope of the appended claims.

The invention claimed is:

1. A method of sampling tracers, comprising:

providing tracers into a wellbore;

taking, automatically, samples of the fluids exiting the wellbore based on a predetermined sampling profile, wherein the predetermined sampling profile comprises a sampling volume, a sampling frequency, and a sampling time period;

quantifying an amount of tracer returning from the well, wherein quantifying an amount of tracer comprises measuring a level of tracer concentration in the samples taken from the fluids exiting the wellbore; and adjusting, automatically, the sampling profile by changing at least one of the sampling volume, the sampling frequency, or the sampling time periods based on the measured tracer concentration in the sample taken from the fluids exiting the wellbore.

2. The downhole sampling tool of claim 1, wherein the profile includes at least one of a samples length.

3. The method of claim 1, wherein the measurement is done real-time at or shortly after the sample is taken.

4. The method of claim 3, wherein at least one sample is rejected based on the measurement.

5. A method of sampling tracers, comprising:

providing tracers into a well;

taking, automatically, samples of a fluid exiting a well at a first sampling profile, wherein the sampling profile comprises a sampling volume, a sampling frequency, and a sampling time period;

measuring a parameter of the fluid or well;

changing, automatically the first sampling profile to a second sampling profile based on the measured parameter, wherein changing the first sampling profile to the second sampling profile comprises changing at least one of the sampling volume, the sampling frequency, or the sampling time periods of the first sampling profile thereby creating the second sampling profile; and taking samples of the fluid exiting the wellbore at the second profile.

6. An apparatus for sampling tracers provided into a wellbore, comprising:

at least one valve fluidly connected to the fluid exiting the wellbore;

at least one sample container fluidly connected to the valve; and a controller operatively connected to the valve, wherein the controller is programmed to automatically operate the valve based on a predetermined sampling profile, wherein the predetermined sampling profile comprises a sampling volume, a sampling frequency, and a sampling time period;

wherein the controller is further programmed to automatically adjust the sampling profile by changing at least one of the sampling volume, the sampling frequency, or the sampling time periods based on a measured tracer concentration in a sample taken from the fluids exiting the wellbore; and, a notification system to notify an operator when a sampling operation has been completed.

* * * * *